US005999558A

United States Patent [19]

Miner, Jr. et al.

[11] Patent Number: 5,999,558

[45] Date of Patent: Dec. 7, 1999

[54] INTEGRAL SPRAY COOLED FURNACE ROOF AND FUME ELBOW

[75] Inventors: Frank Henry Miner, Jr., North Olmsted; Mark Thomas Arthur, Lakewood, both of Ohio

[73] Assignee: Ucar Carbon Technology Corporation, Danbury, Conn.

[21] Appl. No.: 09/132,801

[22] Filed: Aug. 13, 1998

[51] Int. Cl.[6] ..... F27D 1/12

[52] U.S. Cl. ..... 373/74; 373/9; 373/73

[58] Field of Search ..... 373/71, 73, 74, 373/75, 76, 80, 2, 9

[56] References Cited

U.S. PATENT DOCUMENTS

| | | | |
|---|---|---|---|
| 3,169,160 | 2/1965 | Johansson | 266/36 |
| 3,482,827 | 12/1969 | Maide | 266/36 |
| 4,715,042 | 12/1987 | Heggart et al. | 373/74 |
| 4,813,055 | 3/1989 | Heggart et al. | 373/74 |
| 4,815,096 | 3/1989 | Burwell | 373/74 |
| 4,849,987 | 7/1989 | Miner, Jr. et al. | 373/74 |
| 5,330,161 | 7/1994 | Lehr et al. | 266/158 |
| 5,444,734 | 8/1995 | Arthur et al. | 373/73 |
| 5,648,981 | 7/1997 | Miner, Jr. et al. | 373/74 |

*Primary Examiner*—Tu Ba Hoang
*Attorney, Agent, or Firm*—Frederick J. McCarthy

[57] ABSTRACT

Spray cooled roof assembly for a metallurgical vessel, e.g. an electric arc furnace, comprising two spray cooled components, one of which covers a major portion of the furnace, and the other component of the roof assembly having an integral spray cooled extension for the removal of heated gases from the furnace.

7 Claims, 6 Drawing Sheets

INTEGRAL SPRAY COOLED FURNACE ROOF AND FUME ELBOW

BACKGROUND OF THE INVENTION

This invention relates to spray cooled systems for the roof of a metallurgical vessel, e.g. an electric arc furnace, and more particularly to a roof assembly which includes a removable spray cooled component having an integral spray cooled extension for the removal of heated gases and flume from the electric furnace.

SUMMARY OF THE INVENTION

In accordance with the present invention, an annular roof cover assembly is provided comprising a first cover component and a second cover component. The first cover component forms a major portion, e.g., 70 to 85% of the total area of roof cover assembly and defines an enclosed space within which spray nozzles direct coolant in a spray in droplet form. The second cover component laterally abuts and is detachably engaged to the first cover assembly and defines an opening for the escape of hot gases and fume from electric arc furnace and also defines an enclosed space within which spray nozzles direct a spray of coolant onto at least the bottom wall of the second cover compartment and additionally defines an upwardly extending spray cooled hollow duct for the escape of hot gases and flume from the electric arc furnace.

DETAILED DESCRIPTION OF THE INVENTION

Figure 1:
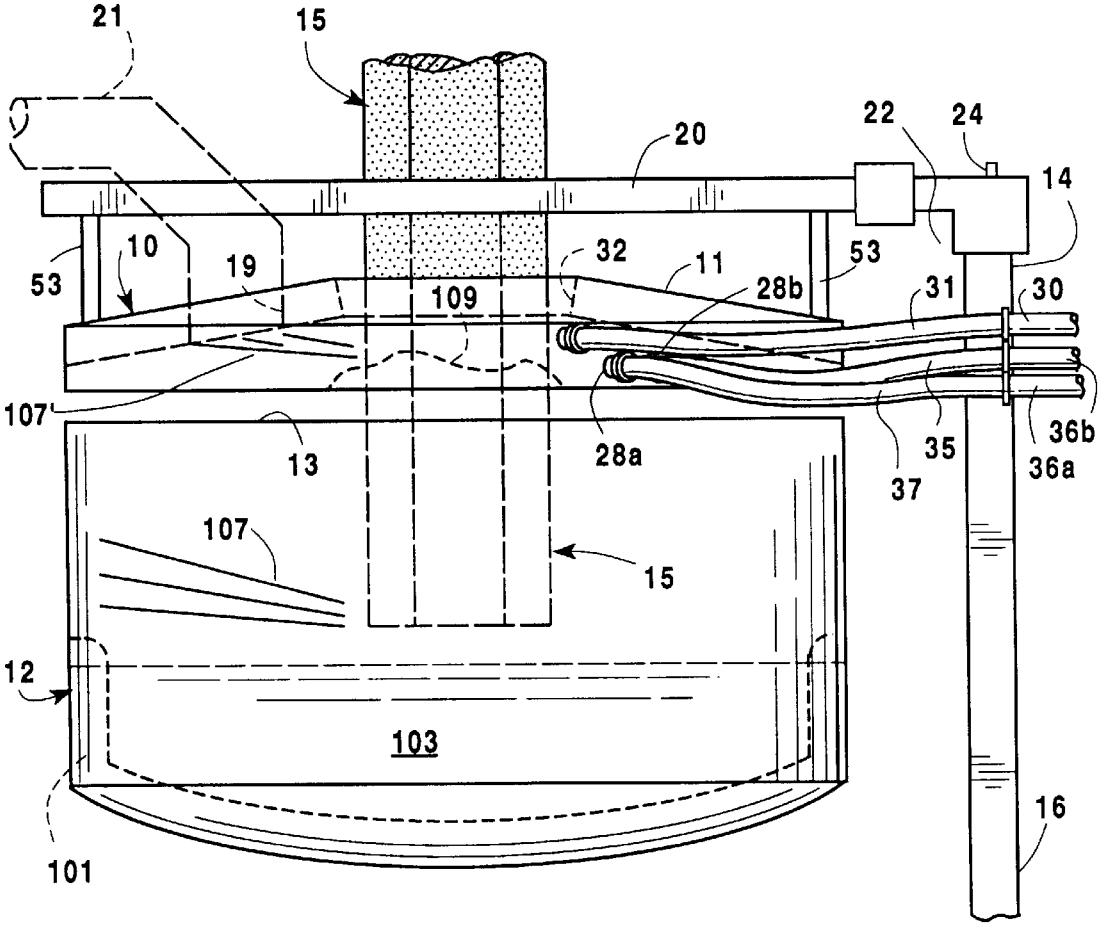
Fig. 1 PRIOR ART
FIG. 1 is a side elevational view of a typical electric furnace installation showing a furnace vessel, a furnace roof in a raised position over the furnace vessel and a mast supporting structure for the roof.
Figure 2:
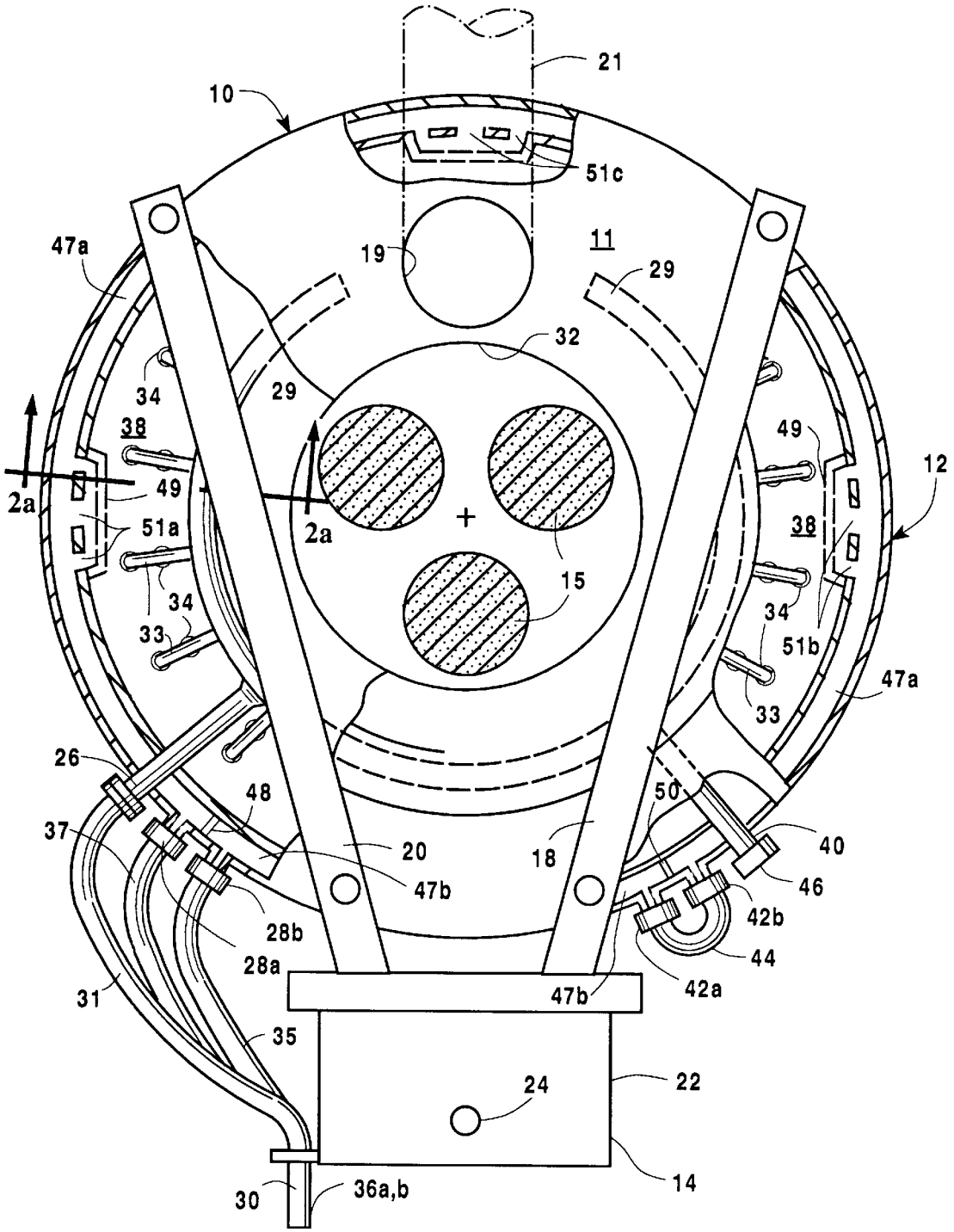
Fig. 2 PRIOR ART
FIG. 2 is a top plan view, partially cut away and partially in section, of a spray cooled furnace roof of FIG. 1.

FIGS. 1–3*a* illustrate a spray cooled electric furnace installation as used for steel making, although the spray cooled furnace roof system can be utilized in any type of metallurgical processing vessel. FIGS. 1, 2, 3 and 3*a* illustrate a prior art spray cooled electric arc furnace installation of the type shown in U.S. Pat. No. 4,849,987—F. H. Miner and A. M. Siffer, in side, top and end views, respectively. The circular water cooled furnace roof 10 is shown being supported by a furnace mast structure 14 in a slightly raised position directly over the rim 13 of electric arc furnace vessel 12. As shown in FIGS. 1 and 2, the roof 10 is a unitary, integral, i.e., one-piece closure component of frusto-conical shape which is attached by chains, cables or other roof lift members 53 to mast arms 18 and 20 which extend horizontally and spread outward from mast support 22. Mast support 22 is able to pivot around point 24 on the upper portion of vertical mast post 16 to swing roof 10 horizontally to the side to expose the open top of furnace vessel 12 during charging or loading of the furnace, and at the other appropriate times during or after furnace operation. Electrodes 15 are shown extending into opening 32 from a position above roof 10. During operation of the furnace, electrodes 15 are lowered through electrode ports of a delta in the central roof opening 32 into the furnace interior to provide the electric arc-generated heat to melt the charge. Exhaust port 19 permits removal of fumes generated from the furnace interior during operation by use of an elbow indicated schematically at 21 in FIGS. 1 and 2.

The furnace system is mounted on trunnions or other means (not shown) to permit the vessel 12 to be tilted in either direction to pour off slag and molten steel.

Figure 3:
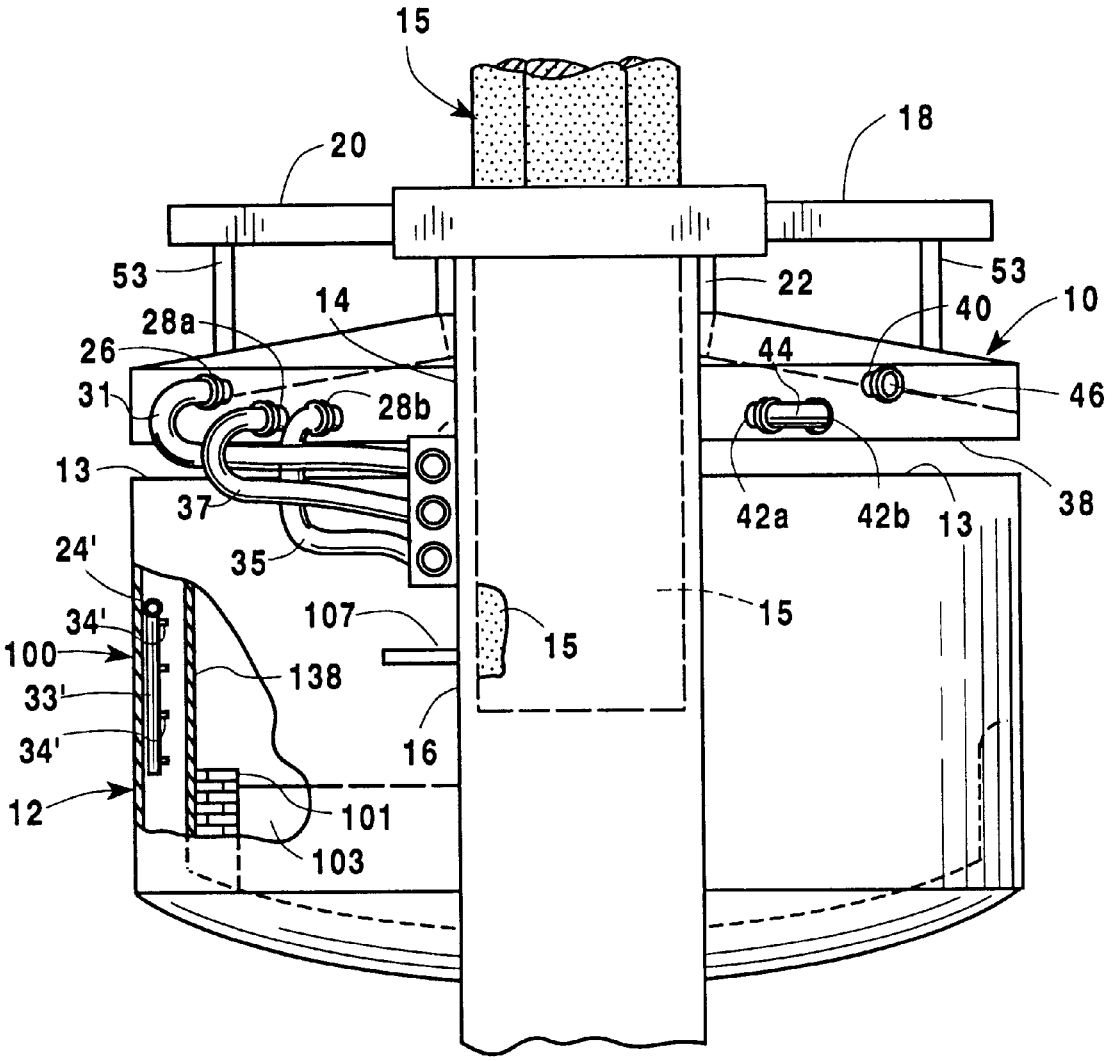
Fig. 3 PRIOR ART
FIG. 3 is an end elevational view, partly in section, of the electric furnace installation of FIG. 1 also showing the refractory lined molten metal-containing portion of the furnace vessel and furnace side wall spray cooling components similar to those of the furnace roof of FIG. 2*a;*

The furnace roof system shown in FIGS. 1, 2 and 3 is set up to be used as a left-handed system whereby the mast 14 may pick up the unitary, one-piece roof 10 and swing it horizontally in a counterclockwise manner (as seen from above) clear of the furnace rim 13 to expose the furnace interior although this is not essential to the present invention which is applicable to all types of electric furnaces or other furnaces which include spray cooled surfaces. To prevent excessive heat buildup on the lower steel surface 38 of roof 10 as it is exposed to the interior of furnace vessel 12, a roof cooling system is incorporated therein. A similar cooling system is shown at 100 in FIG. 3 and FIG. 3*a* for a furnace side wall 138 in the form of a unitary, one-piece cylindrically shaped shell. Refractory liner 101 below cooling system 100 contains a body of molten metal 103. The cooling system utilizes a fluid coolant such as water or some other suitable liquid to maintain the furnace roof side wall or other unitary closure element at an acceptable temperature. The systems described in the aforementioned U.S. Pat. No. 4,715,042, U.S. Pat. No. 4,815,096 and U.S. Pat. No. 4,849,987, the disclosure of which is incorporated herein by reference are preferred. Coolant inlet pipe 26 and outlet pipes 28*a* and 28*b* comprise the coolant connection means for the illustrated left-handed configured furnace roof system. An external circulation system (not shown) utilizes coolant supply pipe 30 and coolant drain pipes 36*a* and 36*b*, respectively, to supply coolant to and drain coolant from the coolant connection means of roof 10 as shown in FIGS. 1–3. The coolant circulation system normally comprises a coolant supply system and a coolant collection system, and may also include coolant recirculation means.

Figure 2A:
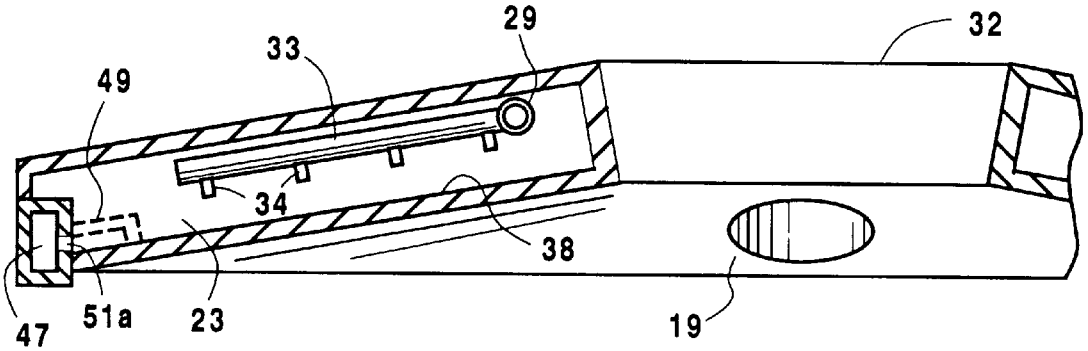
Fig. 2a PRIOR ART
FIG. 2*a* is a cross sectional view along the line 2*a*—2*a* of FIG. 2 also showing a partial elevation view of the furnace roof and, in phantom, a thermally stressed region and proposed cut-out portion of the furnace roof.
Figure 3A:
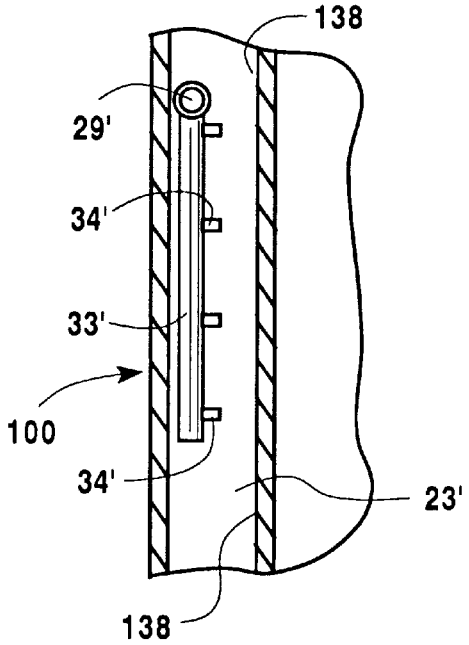
Fig. 3a PRIOR ART
FIG. 3*a* is an enlarged partial view of the sectional portion of FIG. 3.

Attached to coolant supply pipe 30 is flexible coolant supply hose 31 which is attached by quick release coupling or other means to coolant inlet pipe 26 on the periphery of furnace roof 10. As shown best if FIGS. 2 and 2*a*, inlet 26 leads to an inlet manifold 29 which extends around central delta opening 32 in the unpressurized interior of roof 10 or inlet manifold 29 which extends around furnace 13 as shown in FIG. 3. Branching radially outward from manifold 29 in a spoke like pattern is a plurality of spray header pipes 33 to deliver the coolant to the various sections of the roof interior 23. Protruding downward from various points on each header 33 is a plurality of spray nozzles 34 which directed coolant in a spray or droplet pattern to the upper side of roof lower panels 38, which slope gradually downwardly from center portion of the roof to the periphery. The cooling effect of the spray coolant on the lower steel surface 38 of roof 10, and on the outer surface of steel surface 138 of furnace 13, enables the temperature thereon to be maintained at a predetermined temperature range, which is generally desired to be less than the boiling point of the coolant (100° C., in the case of water).

After being sprayed onto the roof lower panels 38, the spent coolant drains by gravity outwardly along the top of roof lower panels 38 and passes through drain inlets or openings 51*a*, 51*b* and 51*c* in a drain system. The drain system shown is a manifold which is made of rectangular cross section tubing or the like divided into segments 47*a* and 47*b*. A similar drain system (not shown) is provided for furnace 13. As seen in FIG. 2, drain openings 51*a*, 51*b* and 51*c* are on opposite sides of the roof. The drain manifold takes the form of a closed channel extending around the interior of the roof periphery at or below the level of roof lower panels 38 and is separated by partitions or walls 48 and 50 into separate draining segments 47*a* and 47*b*. Drain manifold segment 47*a* connects drain openings 51*a*, and 51*c* with coolant outlet pipe 28*a*. Drain manifold segment 47*b* is in full communication with segment 47*a* via connection means 44 and connects drain openings 51*a*, 51*b* and 51*c* with coolant outlet pipe 28*b*. Flexible coolant drain hose 37 connects outlet 28*a* to coolant drain pipe 36*a* while flexible coolant drain hose 35 connects outlet 28*b* and coolant drain pipe 36*b*. Quick release or other coupling means may be used to connect the hoses and pipes. The coolant collection means to which coolant drain pipes 36*a* and 36*b* are connected will preferably utilize jet or other pump means to quickly and efficiently drain the coolant from the roof 10. Any suitable other means to assist draining of the coolant from the roof of furnace shell may also be utilized. Although they are not used as such during left-handed operation of the furnace roof system as shown in FIGS. 1, 2, 2*a* and 2*b*, a second coolant connection means which may be used in a right-handed installation of roof 10 is provided. This second or right-handed coolant connection means comprises coolant inlet 40 and coolant outlet 42. The left and right-handed coolant connection means are on opposite sides of roof 10 relative to a line passing through mast pivot point 24 and the center of the roof, and lie in adjacent quadrants of the roof As with left-handed coolant inlet pipe 26, right-handed coolant inlet pipe 40 is connected to inlet manifold 29. As with the left-handed coolant outlet 28, right-handed coolant outlet 42 includes separate outlet pipes 42*a* and 42*b* which communicate with the separate segments 47*a* and 47*b* of the coolant drain manifold which are split by partition 50. To prevent coolant from escaping through the right-handed coolant connection means during installation of roof 10 in a left-handed system, the present invention also provides for capping means to seal the individual roof coolant inlets and outlets. A cap 46 may be secured over the opening to coolant inlet 40. A removable U-shaped conduit or pipe connector 44 connects and seals the separate coolant outlet openings 42*a* and 42*b* to prevent leakage from the roof and to provide for continuity of flow between drain manifold segments 47*a* and 47*b* around partition 50. Where the draining coolant is under suction, connector 44 also prevents atmospheric leakage into the drain manifold sections.

During operation of the furnace roof as installed in a left-handed furnace roof system, coolant would enter from coolant circulation means through coolant pipe 30, through hose 31, and into coolant inlet 26 whereupon it would be distributed around the interior of the roof by inlet manifold 29. Coolant inlet 40, also connected to inlet manifold 29, is reserved for right-handed installation use and therefore would be sealed off by cap 46. After coolant is sprayed from nozzles 34 on spray headers 33 to cool the roof bottom 38, the coolant is collected and received through drain openings 51*a*, 51*b* and 51*c* into the drain manifold extending around the periphery of the roof 10 and exits through coolant outlet 28. As seen in FIG. 2, coolant draining through openings 51*a*, 51*b* and 51*c* on segment 47*a* of the drain manifold may exit the roof directly through coolant outlet 28*a*, through outlet hose 37 and into drain outlet pipe 36*a* before being recovered by the coolant collection means. Coolant draining through openings 51*a*, 51*b* and 51*c* on segment 47*a* of the drain manifold may also travel through coolant outlet 42*b*, through U-shaped connector 44, and back through coolant outlet 42*a* into manifold segment 47*b* in order to pass around partition 50. The coolant would then drain from drain manifold segment 47*b* through coolant outlet 28*b*, outlet hose 35 and through drain pipe 36*b* to the coolant collection mean. Right-handed coolant outlet 42 is not utilized to directly drain coolant from the roof, but is made part of the draining circuit through the use of U-shaped connector 44. Upon being drained from the roof, the coolant may either be discharged elsewhere or may be recirculated back into the roof by the coolant system. Left-handed coolant connection means 26 and 28 are positioned on roof 10 closely adjacent to the location of mast structure 14 to minimize hose length. Viewing the mast structure 14 and being located at a 6 o'clock position, the left-handed coolant connection means is located at a 7 to 8 o'clock position.

Figure 2B:
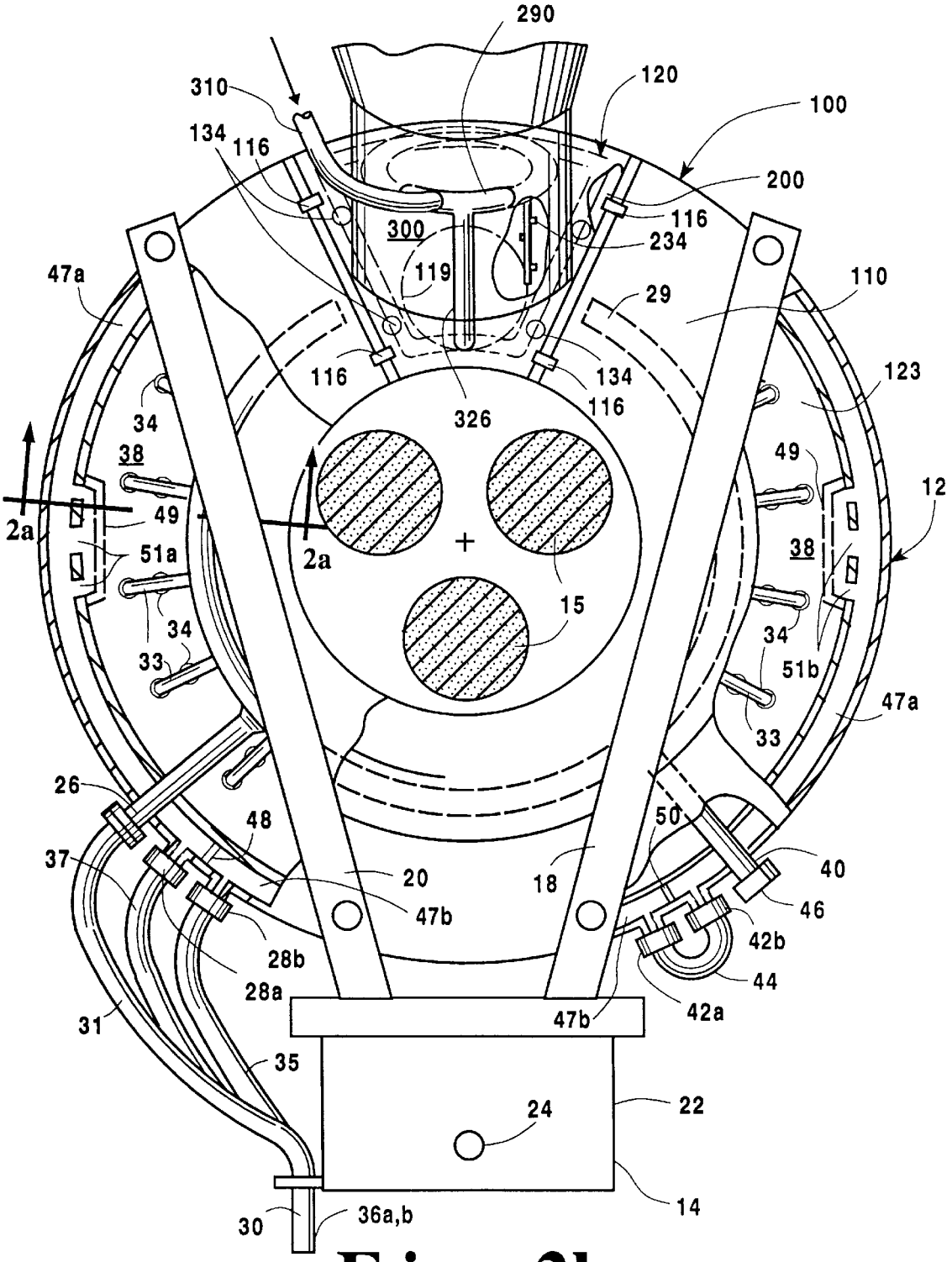
FIG. 2*b* is a top plan view, partially cut away and partially in section, of a spray cooled furnace roof assembly of the present invention.
Figure 4:
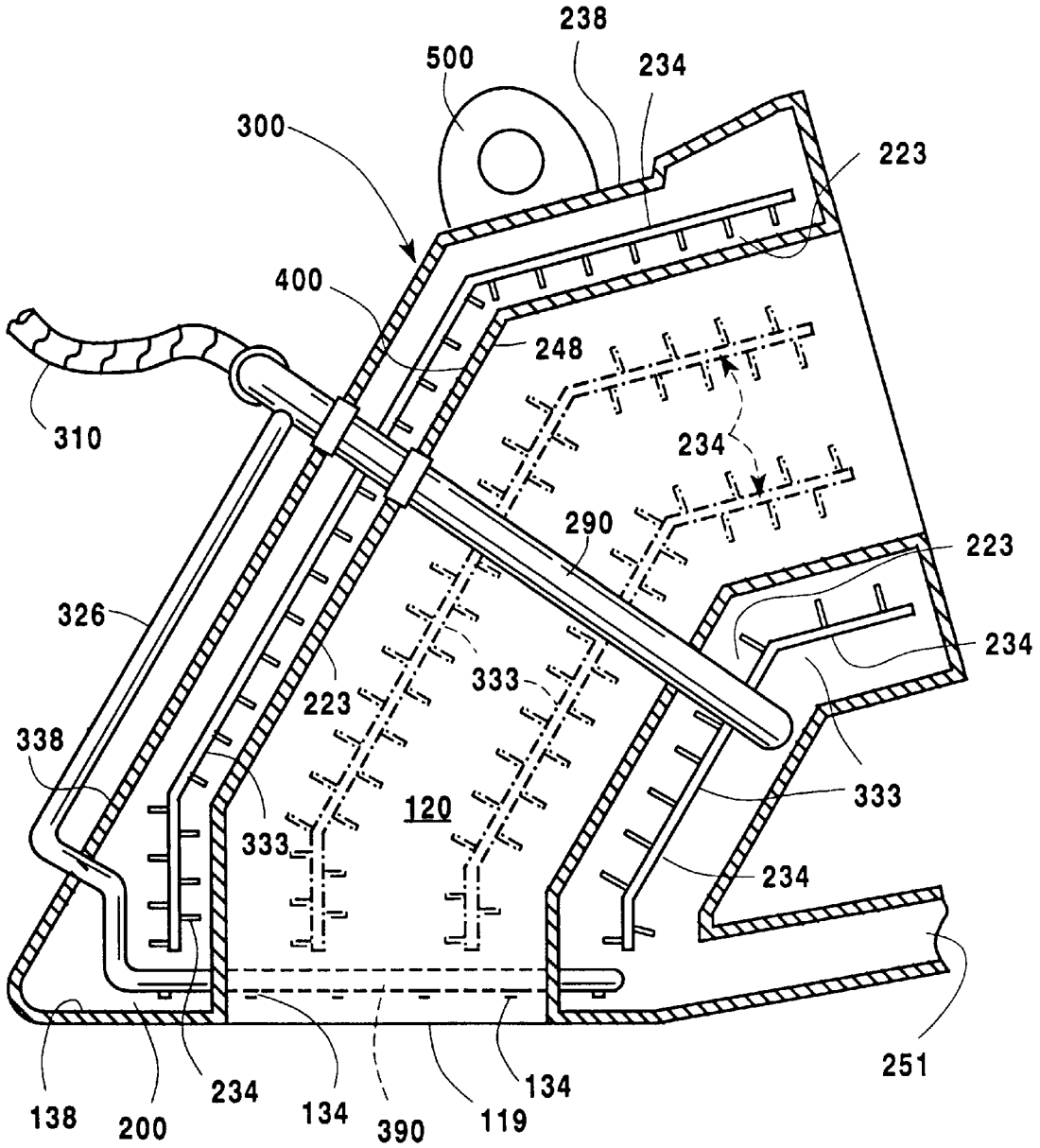
FIG. 4 is a side elevation view of a separately removable component of the assembly of FIG. 2*b*.

In accordance with the present invention, with reference to FIG. 2*b* and FIG. 4, a two component annular roof cover assembly 100 is provided in place of the unitary annular roof 10 shown in FIGS. 1 and 2. The portion of the furnace cover assembly defined by the second cover component is subjected to severe thermal stress and repair and replacement of the roof assembly in this region is relatively frequent. The roof cover assembly 100 comprises a first cover component 110 and a second cover component 120. Coolant is supplied to the first cover component 110 in the same manner as described in connection with the roof 10 of FIGS. 1–3 and coolant is drained from the first cover component 110 in the same manner as roof 10 of FIGS. 1–3. The first cover component 110 is hollow and forms a major portion, e.g., 70 to 85% of the area of roof cover assembly 100 and defines an enclosed space 123 within which spray nozzles 34 direct coolant in a spray in droplet form onto the upper side of lower panels 38 of the first cover component in the same manner as described in connection with FIG. 2. The second cover component 120 is hollow and abuts the first cover assembly 110 and is separate therefrom and may be detachably connected thereto as indicated at 116 and defines an opening 119 for the escape of hot gases and fume from electric arc furnace 12 and also defines an enclosed space 200, as shown more clearly in FIG. 4, within which spray nozzles 134 direct a spray of water onto at least the bottom wall 138 of the second cover component 120; the second cover component additionally defines an upwardly extending duct 300 surrounding the opening 119 for the escape of hot gases and fume from the electric arc furnace 12. Spray nozzles 234 are provided adjacent the inner surfaces 400 within enclosed space 223, (which communicates with enclosed space 200) of the upwardly extending duct 300 defined by the outer wall 238 and inner wall 248 of duct 300 to cool the inner surfaces 400 of the upwardly extending duct 300. Coolant is supplied to the second cover component 120 from flexible coolant supply hose 310 to inlet manifold 290 as shown in FIGS. 2*b* and 4. Inlet manifold 290 extends around the periphery of the upwardly extending duct 300 and is located within enclosed space 223. Branching transversely outwardly from manifold 290 within enclosed space 223 is a plurality of spray header pipes 333 to deliver coolant to spray nozzles 234 to cool the inner wall 248 of upwardly extending duct 300 to maintain a temperature thereon of less than the boiling point of the coolant (100° C. when the coolant is water). Spent coolant from manifold 290 drains by gravity through drain opening 251. A coolant inlet pipe 326 may be provided to supply coolant to an optional inlet manifold 390 which extends around the periphery of closed space 200 of the second cover component which surrounds the opening 119 in the roof cover assembly 100 through which hot gases and fume exit the electric furnace 12. Coolant from manifold 390 is sprayed by spray nozzles 134 to cool the at least the lower surface 138 of enclosed space 200 and also preferably the adjacent portion of outer wall 238 indicated at 338. Spent coolant from manifold 390 also drains by gravity through drain opening 251.

The second cover component 120, when disengaged from the first cover component 110, can be removed using lifting lugs 500, shown in FIG. 4. The integral construction and the cooling of second cover component 120 independently of the first cover component enables quick removal and replacement without affecting the functioning of the first cover component 110 which covers most of the electric arc furnace.

What is claimed is:

1. A roof assembly for a metallurgical vessel electric core furnace comprising:

(i) first and second separate hollow roof cover components assembled in an abutting relationship to form a roof cover;

(a) said first hollow roof cover component having an enclosed space and a lower panel located directly over the metallurgical vessel electric arc furnace and having:

(i) a plurality of spray means located within its enclosed space for directing a spray of liquid coolant in the form of liquid droplets against its lower panel in an amount sufficient to maintain an acceptable temperature in said lower panel;

(ii) a liquid coolant supply manifold for supplying liquid coolant to said spray means;

(iii) a liquid coolant supply conduit for supplying liquid to the liquid coolant supply manifold of said first hollow roof cover component;

(iv) at least one liquid coolant drain outlet means for receiving a flow of liquid coolant from inside said enclosed space of said first hollow roof cover component;

(b) said second hollow roof cover component having an enclosed space and a lower panel located directly over the metallurgical vessel electric arc furnace and defining an exhaust opening for exhausting hot gases from the metallurgical vessel electric furnace, said second roof cover component having:

(i) a plurality of spray means located within its enclosed space for directing a spray of liquid coolant in the form of liquid droplets against its lower panel in an amount sufficient to maintain an acceptable temperature in said lower panel;

(ii) at least one liquid coolant drain outlet means for receiving a flow of liquid coolant from inside said enclosed space of said second hollow roof cover component;

(iii) a generally cylindrical upwardly extending hollow duct integral with said second hollow roof cover component and located above said exhaust opening having an enclosed space communicating with the enclosed space of the second hollow roof cover component and said liquid coolant drain outlet means of said second hollow roof cover component;

(iv) a plurality of spray means located within said enclosed space of said hollow duct for directing a spray of liquid coolant in the form of liquid droplets against the inner surfaces of said hollow duct in an amount sufficient to maintain an acceptable temperature at said inner surfaces;

(v) means for supplying liquid to the plurality of spray means within the enclosed space of the second hollow roof cover and the plurality of spray means within the enclosed space of the hollow duct.

2. A roof assembly for an electric arc furnace comprising:

(i) first and second separate adjacent hollow roof cover components assembled in a lateral abutting relationship to form an annular roof cover of frusto-conical shape with a centrally located opening surrounding at least one graphite electrode extending downwardly into an electric arc furnace:

(a) said first hollow roof cover component having an enclosed space and a lower panel located directly over the electric arc furnace and having (i) a plurality of spray means located within its enclosed space for directing a spray of liquid coolant in the form of liquid droplets against its lower panel in an amount sufficient to maintain an acceptable temperature in said lower panel;

(ii) a liquid coolant supply manifold within said enclosed space and extending adjacent said centrally located opening for supplying liquid coolant to said spray means;

(iii) a liquid coolant supply conduit for supplying liquid to the liquid coolant supply manifold of said first hollow roof cover component;

(iv) at least one liquid coolant drain outlet means for receiving a flow of liquid coolant from inside said enclosed space of said first hollow roof cover component;

(b) said second hollow roof cover component having an enclosed space and a lower panel located directly over the electric arc furnace and defining an exhaust opening for exhausting hot gases from the electric furnace, said second roof cover component having:

(i) a plurality of spray means located within its enclosed space for directing a spray of liquid coolant in the form of liquid droplets against its lower panel in an amount sufficient to maintain an acceptable temperature in said lower panel;

(ii) at least one liquid coolant drain outlet means for receiving a flow of liquid coolant from inside said enclosed space of said second hollow roof cover component;

(iii) a liquid coolant supply manifold within said enclosed space of said second hollow roof cover component and extending around the exhaust opening and also adjacent the centrally located opening of the roof cover assembly for supplying liquid coolant to said spray means;

(iv) a generally cylindrical upwardly extending hollow duct integral with said second hollow roof cover component and located above said exhaust opening having an enclosed space communicating with the enclosed space of the second hollow roof cover component;

(v) a plurality of spray means located within said enclosed space of said hollow duct for directing a spray of liquid coolant in the form of liquid droplets against the inner surfaces of said hollow duct in an amount sufficient to maintain an acceptable temperature at said inner surfaces;

(vi) a liquid coolant supply manifold within said enclosed space of said hollow duct and extending peripherally within said hollow duct for supplying liquid coolant to said spray means located in said hollow duct;

(vii) a liquid coolant supply conduit for supplying liquid to the liquid coolant supply manifold of said second hollow roof cover component and to the liquid coolant supply manifold of said hollow conduct.

3. Roof assembly in accordance with claim 2 wherein the respective liquid coolant supply conduits for the first and second hollow roof cover components and the hollow conduct are connected to a common liquid coolant supply.

4. Roof assembly in accordance with claim 1 wherein the second hollow roof cover component laterally abuts the first hollow roof cover component.

5. Roof assembly in accordance with claim 2 wherein the second hollow roof cover component laterally abuts the first hollow roof cover component.

6. Roof assembly in accordance with claim 4 wherein said first and second hollow roof cover components are detachably connected.

7. Roof assembly in accordance with claim 5 wherein said first and second hollow roof cover components are detachably connected.

* * * * *